US006592103B2

(12) United States Patent
Sennhauser

(10) Patent No.: US 6,592,103 B2
(45) Date of Patent: Jul. 15, 2003

(54) CATCHMENT NET FOR ROCKFALL CATCHMENT SYSTEMS OR THE LIKE

(75) Inventor: Marcel Sennhauser, Frasnacht (CH)

(73) Assignee: Fatzer AG, Romanshorn (CH)

( * ) Notice: Subject to any disclaimer, the term of this patent is extended or adjusted under 35 U.S.C. 154(b) by 0 days.

(21) Appl. No.: 09/986,072

(22) Filed: Nov. 7, 2001

(65) Prior Publication Data

US 2002/0056834 A1 May 16, 2002

(51) Int. Cl.[7] ..... E01F 7/00
(52) U.S. Cl. ..... 256/12.5; 256/35; 256/45
(58) Field of Search ..... 256/12.5, 1, 45, 256/32, 33, 35

(56) References Cited

U.S. PATENT DOCUMENTS 5,395,105 A * 3/1995 Thommen, Jr. ..... 256/12.5
5,435,524 A * 7/1995 Ingram ..... 256/12.5
5,961,099 A * 10/1999 Thommen, Jr. ..... 256/12.5

* cited by examiner

*Primary Examiner*—Lynne H. Browne
*Assistant Examiner*—John R. Cottingham
(74) *Attorney, Agent, or Firm*—Wenderoth, Lind & Ponack, L.L.P.

(57) ABSTRACT

A catchment net for rockfall catchment systems or the like has a net (12, 33) and support elements (16, 17, 18, 19). The net (12, 33) is retained on the outside, on at least two mutually-opposing sides, by least one peripheral cable (14, 15, 41, 42) in each case, and/or by a tensioning cable (22). Additional connection elements (25, 46), which connect the net (12, 33) to the support elements at its outside, make it possible for the energy incurred in the event of a rock (23, 31) or the like falling into the net to be absorbed to the maximum. The connection elements can, however, also be secured additionally or only in the interior of the net.

20 Claims, 3 Drawing Sheets

CATCHMENT NET FOR ROCKFALL CATCHMENT SYSTEMS OR THE LIKE

BACKGROUND OF THE INVENTION

The invention relates to a catchment net for rockfall catchment systems or the like, with a net consisting of mutually-engaging rings or the like, and carrying means supporting the net. The net is retained in position on the outside on at least two mutually-opposing sides by at least one peripheral cable and/or one tensioning cable in each case.

In a catchment net of the generic type according to Specification EP-A-0 679 437, in the first instance individual rings are manufactured, which consist of a wire with several windings. These rings are then encompassed by further rings, until what may be referred to as a ring-net is formed.

Such a net has proved its great value in practice. In the event of a fall of rock or scree into the net, it is possible, with the specified dimensions of the net for a limited amount of energy to be absorbed without the net tearing and without the stonefall, which is to be stopped, falling through the net.

SUMMARY OF THE INVENTION

The object of the present invention is to develop further a catchment net of the generic type, based on the existing catchment net referred to, in such a way that higher energy values can be absorbed by it with relatively low expenditure of effort on design and construction. It is further intended for existing catchment net structures to be subsequently equipped with this invention, in order to allow them likewise to absorb higher energy values. It is further intended that, in the event of failure (tearing) of the peripheral cables or tensioning cables as a result of overloading, the system as a whole should still fulfil its protective task.

This problem is resolved according to the invention in that additional connection elements are provided for, which connect the net on its outside and/or on its interior to the carrying means, such that the energy incurred when a rock or the like falls into the net will be absorbed.

With an embodiment of the catchment net according to the invention, it has transpired that with these additional connection elements a higher value of the energy incurred by the impact of stonefall can be absorbed, up to more than 30%, without the net tearing. These connection elements are easy to manufacture and can, with little expenditure or effort, be secured to the carrying means on the one hand and to or in the net on the other.

These connection elements have proven to be highly advantageous as a means of braking, which have the effect of imposing a defined stretching of the connection element at a corresponding tensile loading.

BRIEF DESCRIPTION OF THE DRAWINGS

An exemplary embodiment of the invention and further advantages thereof are described in greater detail hereinafter on the basis of the accompanying drawings, in which.

DETAILED DESCRIPTION OF THE INVENTION

Figure 1:
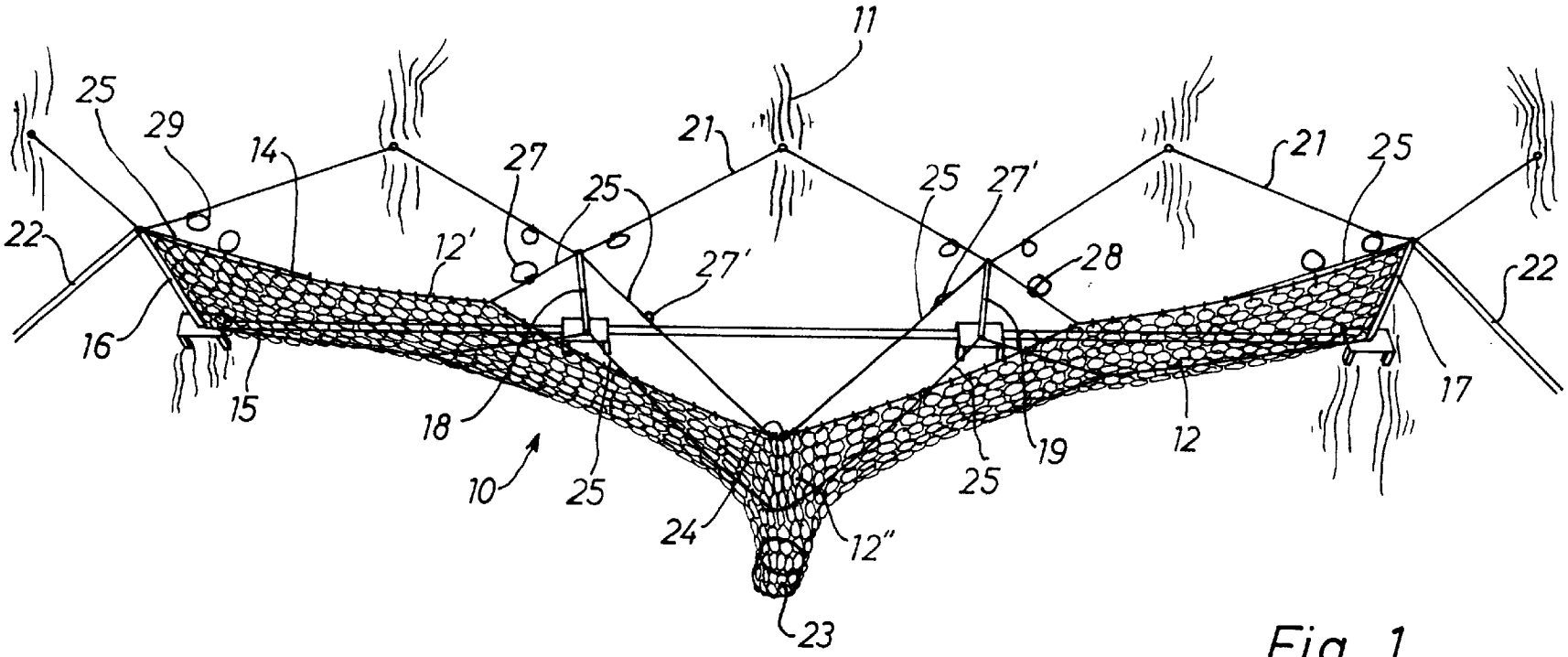
FIG. 1 is a front view of a catchment net designed according to the invention, in a horizontal arrangement as a gallery.

FIG. 1 shows a catchment net 10, which is constructed as what may be referred to as a gallery, and is accordingly arranged in a horizontal fashion. The catchment net 10 features a net 12, which is composed of mutually-engaging rings 12'. The net 12 is in this situation retained on its outer longitudinal sides by a peripheral cable 14, 15 in each case, and by support elements 16, 17 on the outer narrower sides. The support elements 16, 17 are anchored to the overhangs, rock walls 11, etc., which extend approximately vertically upwards in the usual manner, in a position arranged obliquely to the outside. Two further support elements 16, 17 are anchored in the rock between the outer support elements 18, 19, at the same intervals from one another. The additional support elements are arranged parallel to the outer elements, and retain the net at its front end as well as at its foot end. The support elements 16 to 19 are additionally retained by retention cables 21, which are anchored on the one hand to the front end of the support and, on the other, to the rock face. They each extend obliquely to the rear, whereby two retention cables 21 run rearwardly from one support element, to the left and to the right respectively, such that these support elements are secured to the rock face 11 in the optimum manner from the point of view of statics. In addition, lateral tensioning cables 22 are also provided for at the outer support elements 16,17.

Catchment nets 10 of this type are, as a rule positioned above railway lines, roadways, etc., with the function of catching rocks 23, scree, wood such as tree trunks, tree limbs, earth material, and/or the like, such that these materials do not fall onto the rail or road trace below.

According to the invention, additional connection elements 25 are provided for, which connect the net 12 at the outside (periphery) and/or in its interior (inner portion) with the carrying means, so that, in the event of a rock 23 or the like falling into the net 12, the energies incurred will be absorbed. In the present case, the support elements 16 to 19 are used as carrying means. The connection elements 25 could, however, also be secured to the retention cables 21, to separate anchors, or the like.

A connection element 25 with identical dimensions is provided for each support element 16 to 19, in each case at the outside end and at the foot end. Allocated to the support elements 16, 17 located on the outside is in each case a connection element 25, in both directions at the head and foot end. As a result, in each section of the net 12, there are four such connection elements provided in each case between the support elements. The carrying means may of course be fitted with more than four connection elements, or eight respectively.

From this it can be guaranteed that at different parts of the net 12, a capacity for additional energy absorption is created, and the catchment net is accordingly overall in a position to catch rocks with significantly higher weight and/or higher energy values than was possible with the conventional nets.

The connection element 25 in each case is integrated to advantage with at least one means of braking (braking device) 27, 27', which, in the event of a rock or the like falling into the net, the tensile and other energies incurred will be absorbed in proportion by the net. Such means of braking are explained in U.S. Pat. No. 5,207,302. These means are formed to advantage from a ring, which consists, for example, of a bent metal tube (metal rod), which is connected at one end to a cable, retained by a support element, and at the other end to a cable secured to the net. The adjacent end sections of the metal tube are also encompassed by a clamping ring 28. The retaining cables 21 are also equipped with such braking means 29.

In the state as shown, the connection elements 25, and with them the braking means 27', into which the rock 23 has fallen, are extended in the center section of the net 12, i.e. their rings have become correspondingly smaller. With a correspondingly higher loading, these rings tear free, forming a predetermined break section.

A further advantage according to the invention derives from the fact that these connection elements 25 can be replaced by new ones with no difficulty in the event of damage being incurred, if they tear, or at least if the rings are stretched. In effect, a predetermined break point or predetermined damage point at a defined energy level is formed in this catchment net, which can easily be replaced. This is effected by the reference break or damage points being released from the carrying means and from the net, and by the appropriate securing of new connection elements.

To great advantage, the net 12 is located in a displaceable manner on the peripheral cables 14, 15 by means of sliding elements 24, whereby each sliding element 24 is looped around a peripheral-side ring 12' and around the peripheral cable 14, 15.

Because of this arrangement, a further substantial advantage is obtain within the framework of the invention, in that, when the rock falls into the net, the ring bundles are pushed in rows 12", as occurs with a curtain, transverse to the peripheral cables against the site of the impact, which results in increased strength of the net in the impact area.

Because of the connection elements 25, the situation is attained in that the rows of rings are held back against the point of impact. At the moment at which the falling rock impacts into the net and draws it downwards, as can be seen from FIG. 1, the connection elements 25 are drawn together until, in a first stage, the braking rings 27' are stretched as shown and, in a second stage, the connection elements tear. This allows for a definable proportion to be absorbed of the total absorption energy required.

Figure 2:
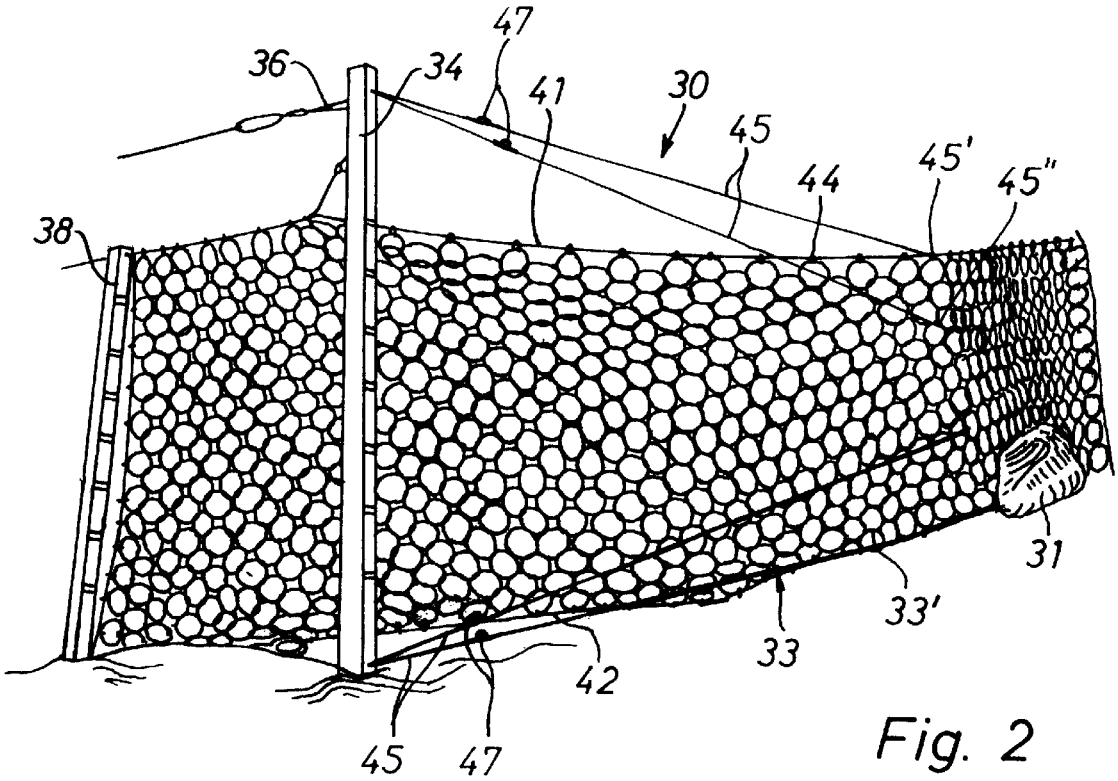
FIG. 2 is a part view of a catchment net designed according to the invention, in a vertical arrangement.

FIG. 2 shows an approximately vertically arranged catchment net 30 in a partial view, which, by contrast with that according to FIG. 1, is arranged on an oblique incline, and the material falling down the incline, such as rocks 31, are caught. The catchment net 30 is secured to approximately vertical support elements 34, 38, provided as carrying means, which are held by retaining cables 36. A net 33 consists in turn of rings 33' slid onto one another, which in each case are formed from several windings of a wire. The net 33 is retained at the top and bottom by peripheral cables 41, 42, running approximately horizontally, whereby slide elements 44 provided at the rings 33' in turn provide for the possibility of the displacement of the net 33 along these peripheral cables 41, 42, in the same manner as with a curtain.

According to the invention, connection elements 45 are provided for, which on the one hand connect the net 33 at its outside at its top 45' and at its bottom respectively, and, on the other hand, connect it in its interior 45"with the support elements 34, 38, whereby in each case two connection elements are secured to this support element at the upper end and two at the lower end. The two connection elements extended in the interior 45"of the net feature an approximately equal length, and one of them is secured in the upper half of the net and the other in the lower half. The connection elements 45 in the section of the net into which the rock 31 has impinged are extended in turn. Accordingly, the rings of the braking means 47 are in each case reduced from a diameter of, for example, 25centimeters in the unladen state, to a small diameter of only a few centimeters.

In FIG. 2 it can be very clearly seen that, due to the impact of the rock into the net, the ring bundles of the net have been displaced transverse to the peripheral cables 41, 42, in rows, in the manner of a curtain. The individual rings on the outside of the net are for this purpose in turn retained at the individual peripheral cable 41, 42 in a displaceable manner by means of slide elements. The connection elements 45 have, in the sense of the invention, counteracted this displacement of the ring bundles with a defined resistance.

Figure 3:
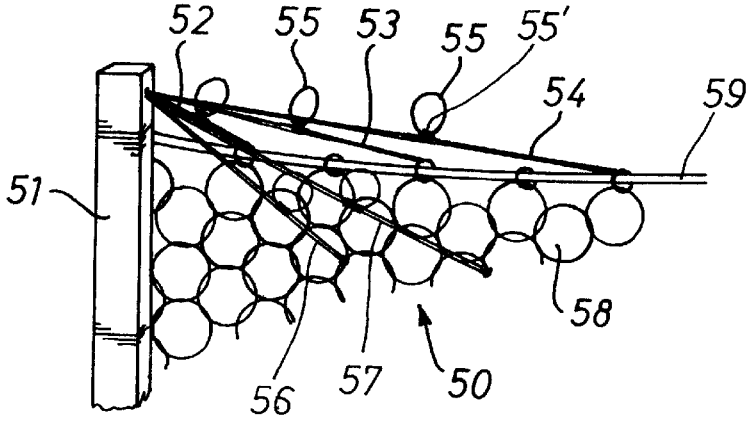
FIG. 3 is a part view of a variant of a catchment net.

FIG. 3 shows a section of a catchment net system 50, which features several connection elements 52, 53, 54, 56, 57, extending in the same direction and arranged at the same place at the support element 51. The connection elements are in turn each equipped with braking means 55. The connecting elements 52, 53, 54 are engaged on the outside of the net 50, while the connection elements 56, 57 are secured inside the net. In relation to the plane of the figure, the two latter connection elements 56, 57 are arranged in front of the peripheral cable 59, carrying the net, while this peripheral cable is in turn arranged behind the support element 51 on the valley side. The braking means 55, functioning in the manner of a shock absorber, have in each case, at the adjacent ends, a circumferential clamping ring 55'. The connection elements 52, 53, 54, 56, 57, starting from the support element 51, are in each case provided with a different length, and accordingly are secured to the net 58, on the one hand to its outside and, on the other, to its inside, at different places and at defined intervals, so that these connection elements will, in the event of a rock fall, absorb energy in sequence or all together, until they tear.

In the event of a rock impact, the net is first stretched perpendicular to its longitudinal extension, and in the process the individual rows of rings running transverse to the longitudinal extension are drawn one after another in the direction against the impact point. As soon as the row which engages on the outside with a connection element 54 is drawn in, the mutually-opposed connection elements on both sides exert a retention effect on the rows of rings, until their brake rings are stretched and tear as a result, so that the next connection element 53 come into play, since the rows of rings are drawn further.

Figure 4:
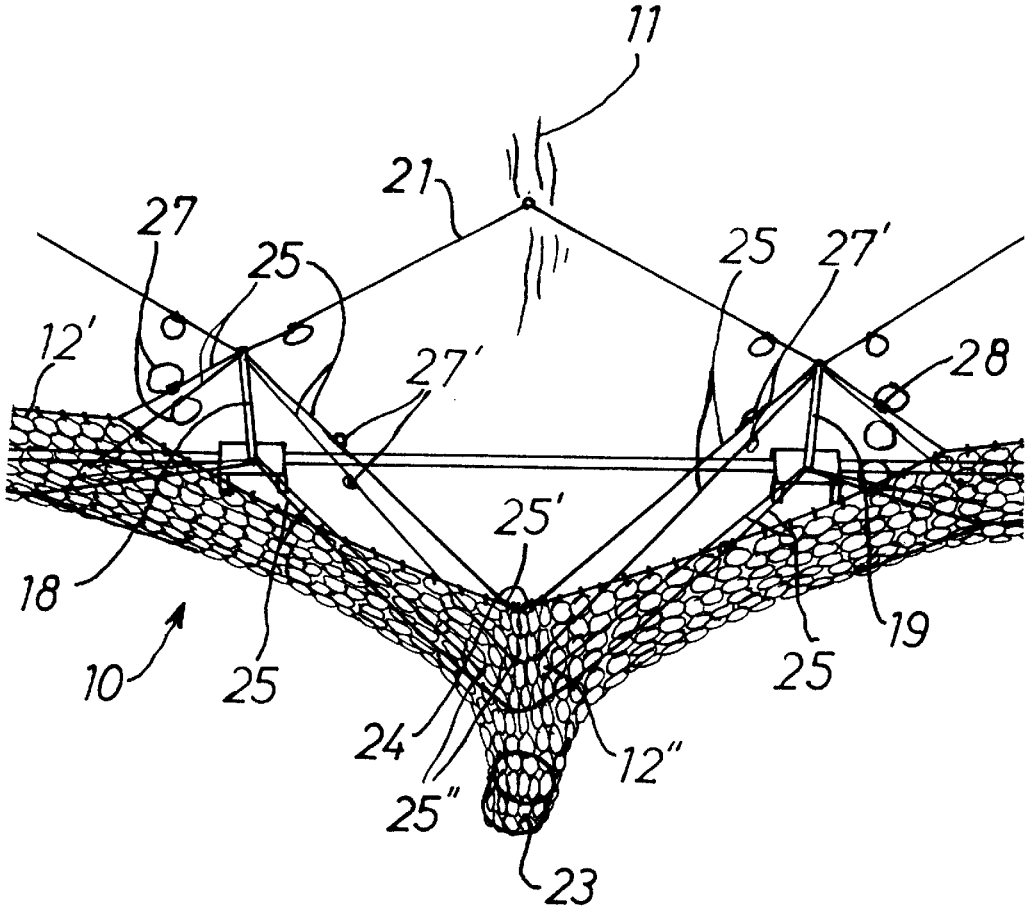
FIG. 4 is a partial front view of the catchment net according to FIG. 1, in which additional connection elements are provided.

FIG. 4 shows additional connection elements 25 in another variant of the catchment net 10, which are secured at one end to the outer or inner end respectively of the support elements 18, 19, and at the other end 25"are secured not to the outside but inside the net. From the support elements 18, 19, two connection elements go in both directions respectively, inside and outside. This results in an increased catchment strength of the net in comparison with the embodiment according to FIG. 1; i.e. even heavier objects can be reliably caught by the net.

The invention is adequately represented with the embodiments described heretofore. It may of course be represented likewise in other embodiments.

For example, the connection elements could, depending on the application, be provided with different materials and dimensions, as well as with different lengths according to FIG. 3, with the result that different absorption capacities, tear resistance values, or braking effects can be achieved. In principle, it would also be possible for several connection elements to be installed, in parallel and/or in series with one another.

The catchment net according to FIG. 1 may of course also be arranged on an oblique slope, as a gallery. The number, and the length and breadth respectively, of the fields formed by the spaced support elements may be adapted at will depending on the local circumstances.

The peripheral cables could also be established by means of a double cable guide, whereby for preference the appropriate brake rings are arranged at the support elements.

The braking means could of course also be designed in a different manner to that described heretofore, or designed as inherently-known friction elements.

In principle, the connection elements could be secured only in the interior of the net and not at the outside, this not being represented in any greater detail. The connection elements could also be arranged at the carrying means not only on the end side, but also at any desired location, such as in the center of the support element.

In the unladen state of the net, the connection elements are provided with such a length that they sag to a certain degree, and are not already at full stretch. If only one rock falls into the net, this arrangement makes it possible for the net, as shown, to be displaced in the manner of a curtain, before these connection elements are extended, and the net can only be displaced to a restricted degree.

What is claimed is:

1. A catchment net for rockfall catchment systems, said catchment net comprising:

a net comprising a plurality of mutually-engaging rings;

carrying means supporting said net;

at least one of at least one peripheral cable and at least one tensioning cable retaining said net in position on each of at least two mutually-opposing sides of said net; and a plurality of connection elements connecting at least one of an outer periphery of said net and an inner portion of said net to said carrying means, wherein said plurality of connection elements are adapted to absorb energy incurred on said net.

2. A catchment net according to claim 1, further comprising at least one breaking means integrated with each of said plurality of connection elements, wherein said breaking means are operable to absorb energy incurred on said net.

3. A catchment net according to claim 2, wherein said braking means each comprise a ring and a clamping ring encompassing adjacent end areas of said ring, a first end of said ring being connected to a first portion of a respective one of said plurality of connection elements retained by said carrying means and a second end of said ring being connected to a second portion of said respective one of said plurality of connection elements engaged with said net.

4. A catchment net according to claim 1, wherein said at least one of said at least one peripheral cable and said at least one tensioning cable is said at least one peripheral cable retaining said net in a position on each of said at least two mutually-opposing sides of said net, and said at least one peripheral cable on each of said at least two mutually-opposing sides of said net passes through a number of said plurality of mutually-engaging rings located at said at least two mutually-opposing sides of said net such that said net is displacable along said at least one peripheral cable on each of said at least two mutually-opposing sides of said net.

5. A catchment net according to claim 1, wherein at least two of said plurality of connection elements are connected to each of said carrying means, said at least two connection elements having different lengths and being connected to said net at different points at defined intervals from each other.

6. A catchment net according to claim 1, wherein said net and said plurality of connection elements absorb amounts of energy that are matched to one another.

7. A catchment net according to claim 1, wherein each of said carrying means has an outer end and a foot end, and at least one of said plurality of connection elements is respectively connected to each of said outer ends and said foot ends of said carrying means.

8. A catchment net according to claim 1, wherein a first end of each of said plurality of connection elements is connected to one of said at least one of said at least one peripheral cable and said at least one tensioning cable retaining said net in position on each of said at least two mutually-opposing sides of said net and a second end of each of said plurality of connection elements is connected to at least one of said plurality of mutually-engaging rings at said inner portion of said net.

9. A catchment net according to claim 1, wherein each of said plurality of connection elements engages with at least two of said carrying means located at opposite sides of said outer periphery of said net and engages with at least an additional two of said carrying means located at said inner portion of said net.

10. A catchment net according to claim 1, wherein said plurality of connection elements are connected to said net in pairs.

11. A catchment net according to claim 3, wherein said rings each comprise a metal tube.

12. A catchment net according to claim 10, wherein said pairs of said plurality of connection elements are symmetrical with a center of said net.

13. A catchment net for rockfall catchment systems, said catchment net comprising:

a net comprising a plurality of mutually-engaging rings;

a plurality of support elements supporting said net;

at least one of at least one peripheral cable and at least one tensioning cable retaining said net in position on each of at least two mutually-opposing sides of said net; and a plurality of connection elements connecting at least one of an outer periphery of said net and an inner portion of said net to said carrying means, wherein said plurality of connection elements are adapted to absorb energy incurred on said net.

14. A catchment net according to claim 13, further comprising at least one breaking device integrated with each of said plurality of connection elements, wherein said breaking devices are operable to absorb energy incurred on said net.

15. A catchment net according to claim 14, wherein said braking devices each comprise a ring and a clamping ring encompassing adjacent end areas of said ring, a first end of said ring being connected to a first portion of a respective one of said plurality of connection elements retained by said support elements and a second end of said ring being connected to a second portion of said respective one of said plurality of connection elements engaged with said net.

16. A catchment net according to claim 13, wherein said at least one of said at least one peripheral cable and said at least one tensioning cable is said at least one peripheral cable retaining said net in a position on each of said at least two mutually-opposing sides of said net, and said at least one peripheral cable on each of said at least two mutually-opposing sides of said net passes through a number of said plurality of mutually-engaging rings located at said at least two mutually-opposing sides of said net such that said net is displacable along said at least one peripheral cable on each of said at least two mutually-opposing sides of said net.

17. A catchment net according to claim 13, wherein at least two of said plurality of connection elements are connected to each of said support elements, said at least two connection elements having different lengths and being connected to said net at different points at defined intervals from each other.

18. A catchment net according to claim 13, wherein each of said support elements has an outer end and a foot end, and at least one of said plurality of connection elements is respectively connected to each of said outer ends and said foot ends of said support elements.

19. A catchment net according to claim 13, wherein a first end of each of said plurality of connection elements is connected to one of said at least one of said at least one peripheral cable and said at least one tensioning cable retaining said net in position on each of said at least two mutually-opposing sides of said net and a second end of each of said plurality of connection elements is connected to at least one of said plurality of mutually-engaging rings at said inner portion of said net.

20. A catchment net according to claim 13, wherein each of said plurality of connection elements engages with at least two of said support elements located at opposite sides of said outer periphery of said net and engages with at least an additional two of said support elements located at said inner portion of said net.

* * * * *